US005234219A

United States Patent [19]

Lin

[11] Patent Number: 5,234,219

[45] Date of Patent: Aug. 10, 1993

[54] MAGNETICALLY FLOATING PICTURE-FRAME TARGET MEANS

[76] Inventor: Johnson Lin, c/o Hung Hsing Patent Service Center, P.O. Box 55-1670, Taipei (10477), Taiwan

[21] Appl. No.: 924,902

[22] Filed: Aug. 5, 1992

[51] Int. Cl.[5] ..... F41J 5/24

[52] U.S. Cl. ..... 273/392; 273/370; 446/129

[58] Field of Search ..... 273/359, 369, 370, 378, 273/386, 390–393; 446/129, 132, 133

[56] References Cited

U.S. PATENT DOCUMENTS

| | | | |
|---|---|---|---|
| 2,702,191 | 2/1955 | Lemelson | 273/393 |
| 2,819,903 | 1/1958 | Saunders | 273/386 |
| 3,603,027 | 9/1971 | Fung | 446/133 |
| 4,753,623 | 6/1988 | Krut | 446/133 |

*Primary Examiner*—Paul E. Shapiro

[57] ABSTRACT

A picture frame target device includes a plurality of picture frames pivotally held on a base platform of a supporting frame each picture frame having a ferrous object mounted on the picture frame, and a plurality of magnets embedded in a magnet carrying plate positioned above and adjacent to the picture frames each magnet magnetically attracting a ferrous object mounted on each picture frame therein each picture frame is magnetically attached to each magnet on an upper portion of the supporting frame to pose like a floating condition on the base platform, whereby upon a shooting of an elastic band or rubber ring on each picture frame which is served as a target device, the picture frame once struck will be reciprocatively vibrated, but not turning its up side down, to enhance a player's interest and also for decorative purpose.

1 Claim, 2 Drawing Sheets

MAGNETICALLY FLOATING PICTURE-FRAME TARGET MEANS

BACKGROUND OF THE INVENTION

U.K. Patent No. 597,434 to Carl A. Norling disclosed a mechanical game of skill consisting of a launching or firing device from which appropriately formed missiles or projectiles are discharged towards a target device. The target device comprises a suitable stand upon which a series of target elements are pivotally mounted in the line and have balance weights associated therewith to keep them upright, the mounting being such that when any one target element is struck by a missile it falls over backwards and assumes a hanging down position, the balance weight sliding towards a fulcrum point and keeping the said target element in a depending position.

However, if the target device is struck by a rubber ring or elastic band discharged from a toy pistol, the rubber ring is a soft object which is not strong enough to strike the target element (12) to fall over backwards.

It is therefore expected to disclose a target means especially suitable for the striking of a rubber ring shot from a toy pistol for playing interest.

SUMMARY OF THE INVENTION

The object of the present invention is to provide a picture frame target device including a plurality of picture frames pivotally held on a base platform of a supporting frame each picture frame having a ferrous object mounted on the picture frame, and a plurality of magnets embedded in a magnet carrying plate positioned above and adjacent to the picture frames each magnet magnetically attracting a ferrous object mounted on each picture frame therein each picture frame is magnetically attacted to each magnet on an upper portion of the supporting frame to pose like a floating condition on the base platform, whereby upon a shooting of an elastic band or rubber ring on each picture frame which is served as a target device, the picture frame once struck will be reciprocatively vibrated, but not turning its up side down, to enhance a player's interest and also for decorative purpose.

DETAILED DESCRIPTION

Figure 1:
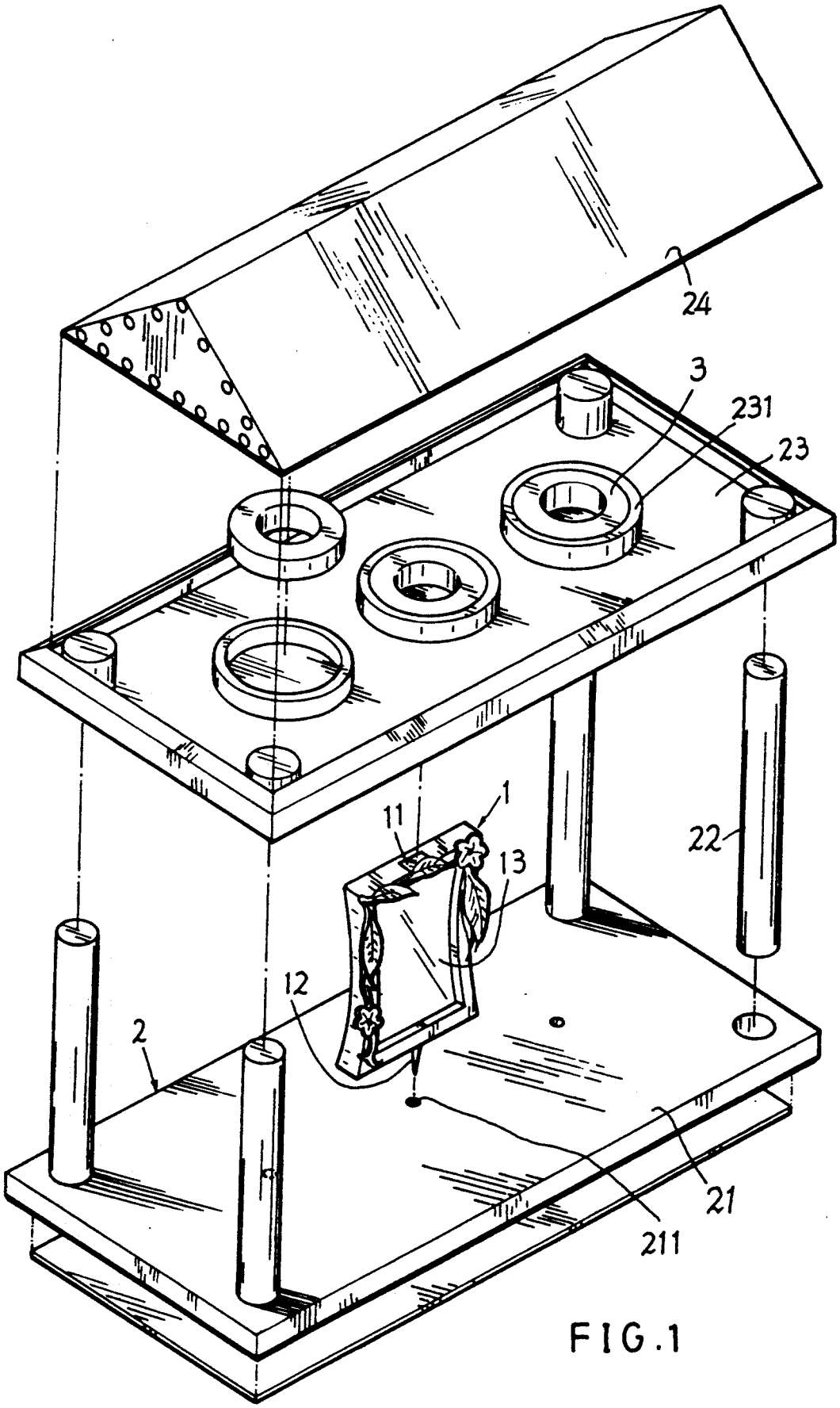
FIG. 1 is an exploded view of the present invention.
Figure 2:
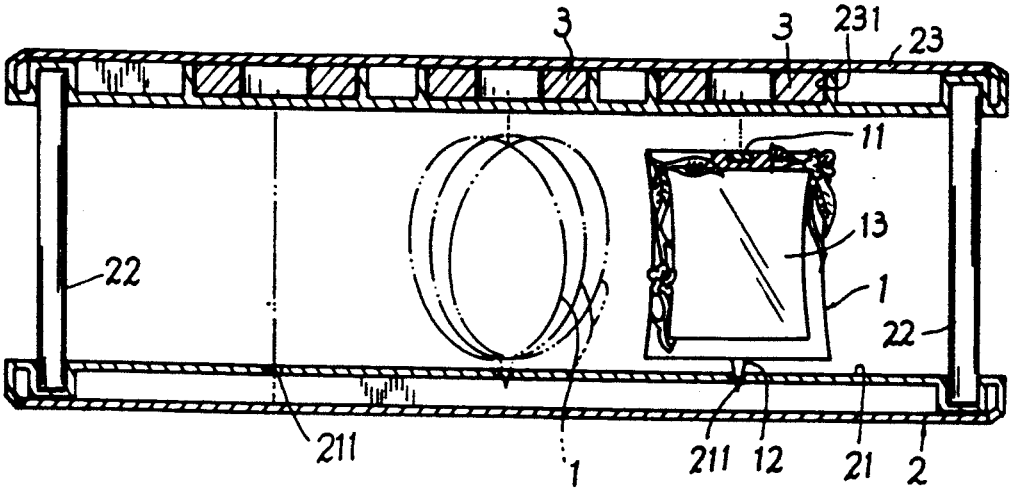
FIG. 2 is a sectional drawing of the present invention.
Figure 3:
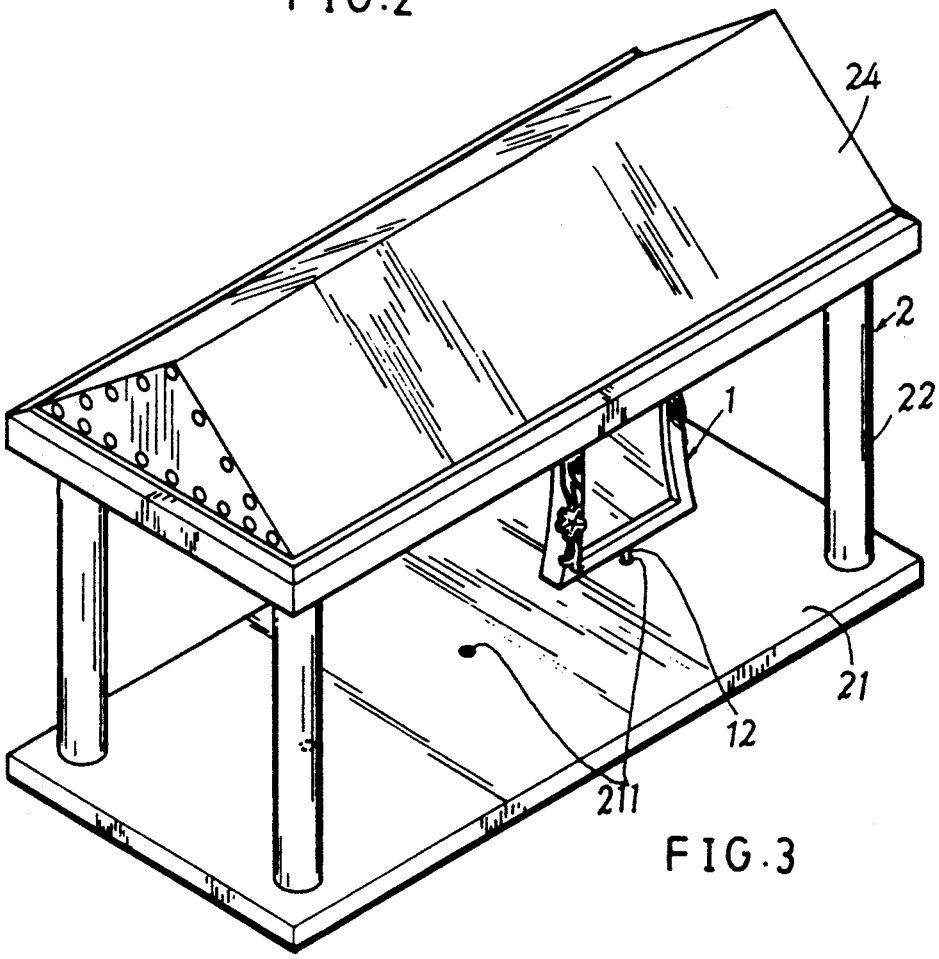
FIG. 3 is a perspective view of the present invention.

As shown in the drawing figures, the present invention comprises: a plurality of picture frames 1, a supporting frame 2, and a plurality of magnets 3.

Each picture frame 1 includes: a magnetically attractable object made of ferrous material 11 fixed in an upper portion of the picture frame 1, a pivot 12 protruding downwardly from a bottom portion of the picture frame 1, and a photograph or picture 13 embedded in a central front portion of the picture frame 1.

The supporting frame 2 includes: a base platform 21 having a plurality of pivot holes 211 drilled in the base platform 21 each pivot hole 211 movably engageable with each pivot 12 of each picture frame 1, a plurality of columns 22 protruding upwardly from the base platform 22, a magnet carrying plate 23 horizontally secured on an upper end portion of each column 22 to be positioned slightly above the picture frames 1 having a plurality of sockets 231 formed in the magnet carrying plate 23 for embedding each magnet 3 in each socket 231 to be adjacent to each magnetically attractable object 11 formed on each picture frame 1, and a top cover 24 shielding the magnet carrying plate 23.

Other structures or designs of the supporting frame 2 may be modified and are not limited in this invention.

When using the present invention, each picture frame 1 is pivotally held on the base platform 21 by engaging each pivot 12 formed on the bottom portion of the picture frame 1 with each pivot hole 211 formed in the base platform 21 to position each magnetically attractable object 11 made of ferrous material to be adjacent to each magnet 3 embedded in each socket 231 in the magnet carrying plate 23 positioned above the picture frames 1 so that each magnetically attractable object 11 in each picture frame 1 will be magnetically attracted by each magnet 3 in the carrying plate 23 but leaving each pivot 12 of the picture frame 1 still held within the pivot hole 211 in the base platform 21 so as to suspendingly "float" each picture frame 1 slightly above the base platform 21. A magnetic force between the magnet 3 and the ferrous object 11 generally equals to a gravitational force of each picture frame 1.

Upon a shooting of an elastic band, for example, as discharged from a toy gun or pistol or even from a player's hands against the picture frame 1, the picture frame 1 will be reciprocatively vibrated about the pivot 12 movably engageable with the pivot hole 211 in the base platform 21. However, since the striking force by an elastic hand or rubber ring is not strong enough to "pull" the pivot 12 of the picture frame 1 from the pivot hole 211 in the base platform to cause the picture frame falling down or backwardly towards the base platform 21. A vibration of the picture frame 1 will indicate the specific picture frame being struck, thereby saving any restoring or recovery action such as for keeping a target device at its upright pose as found in a conventional target device.

Meanwhile, the picture frame 1 as magnetically attracted to the magnet 3 mounted in an upper portion of the supporting frame 2 will act like a floating article which will slightly vibrate, shake or move to vividly enhance a decorative effect for the picture frame having picture of photograph 13 embedded in the picture frame 1.

I claim:

1. A picture-frame target means comprising:

a supporting frame having a base platform drilled with a plurality of pivot holes in the base platform;

a plurality of picture frames each said picture frame having a pivot protruding downwardly from a bottom portion of said picture frame to be movably engageable with each said pivot hole formed in said base platform, and a magnetically attractable object made of ferrous material fixing in an upper portion of each said picture frame; and a plurality of magnets embedded in an upper portion of said supporting frame each said magnet positioned above and adjacent to each said magnetically attractable object on said picture frame, each said magnetically attractable object of said picture frame magnetically attracted by each said magnet so as to suspendingly float said picture frame to be slightly above said base platform with each said pivot still movably engageable in each said pivot hole in said base platform, whereby upon a shooting of an elastic band against said picture frame which is served as a target device, said picture frame once being struck will be reciprocatively vibrated, without being turned its up side down, for player's interest;

having a magnetic force acting between each said picture frame and each said magnet generally equal to a gravitational force of each said picture frame; and said supporting frame including: a plurality of columns protruding upwardly from the base platform, a magnet carrying plate horizontally secured on an upper end portion of each said column to be positioned slightly above the picture frames having a plurality of sockets formed in the magnet carrying plate for embedding each said magnet in each said socket to be adjacent to each magnetically attractable object formed on each picture frame, and a top cover shielding the magnet carrying plate.

* * * * *